US009500969B2

(12) United States Patent
Ikuta et al.

(10) Patent No.: US 9,500,969 B2
(45) Date of Patent: Nov. 22, 2016

(54) ELECTROPHOTOGRAPHIC TONER AND METHOD FOR PRODUCING THE SAME

(71) Applicants: TOSHIBA TEC KABUSHIKI KAISHA, Shinagawa-ku, Tokyo (JP); KABUSHIKI KAISHA PILOT CORPORATION, Chuo-ku, Tokyo (JP); THE PILOT INK CO., LTD., Showa-ku, Nagoya-shi, Aichi (JP)

(72) Inventors: Masahiro Ikuta, Shizuoka-ken (JP); Takahito Kabai, Shizuoka-ken (JP); Takayasu Aoki, Shizuoka-ken (JP); Tsuyoshi Itou, Shizuoka-ken (JP)

(73) Assignees: Toshiba Tec Kabushiki Kaisha, Tokyo (JP); Kabushiki Kaisha Pilot Corporation, Tokyo (JP); The Pilot Ink Co., Ltd., Nagoya-shi, Aichi (JP)

( * ) Notice: Subject to any disclaimer, the term of this patent is extended or adjusted under 35 U.S.C. 154(b) by 0 days.

(21) Appl. No.: 14/731,687

(22) Filed: Jun. 5, 2015

(65) Prior Publication Data

US 2015/0268571 A1 Sep. 24, 2015

Related U.S. Application Data

(62) Division of application No. 13/251,455, filed on Oct. 3, 2011, now abandoned.

(60) Provisional application No. 61/389,886, filed on Oct. 5, 2010.

(30) Foreign Application Priority Data

Aug. 15, 2011 (JP) ..... 2011-177698

(51) Int. Cl.

| | |
|---|---|
| ***G03G 5/00*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/081* (2013.01); *G03G 9/0806* (2013.01); *G03G 9/0812* (2013.01); *G03G 9/0819* (2013.01); *G03G 9/0827* (2013.01); *G03G 9/08755* (2013.01); *G03G 9/0926* (2013.01); *G03G 9/0928* (2013.01)

(58) Field of Classification Search

CPC ... G03G 9/081; G03G 9/08755; G03G 9/093
USPC ..... 430/108.1, 110.2, 110.3, 110.4, 137.14
See application file for complete search history.

(56) References Cited

U.S. PATENT DOCUMENTS

| | | | |
|---|---|---|---|
| 6,203,603 | B1 | 3/2001 | Takayama et al. |
| 6,699,632 | B2 | 3/2004 | Higuchi et al. |
| 7,794,912 | B2 | 9/2010 | Urabe et al. |
| 8,541,156 | B2 | 9/2013 | Aoki et al. |
| 2006/0029433 | A1 | 2/2006 | Saito et al. |
| 2010/0209839 | A1 | 8/2010 | Kabai et al. |
| 2010/0304286 | A1 | 12/2010 | Aoki et al. |
| 2011/0294052 | A1 | 12/2011 | Aoki et al. |
| 2013/0029257 | A1 | 1/2013 | Fujita et al. |
| 2013/0336677 | A1 | 12/2013 | Aoki et al. |

FOREIGN PATENT DOCUMENTS

| | | |
|---|---|---|
| EP | 2219081 | 8/2010 |
| EP | 2325700 | 5/2011 |
| EP | 2341394 | 7/2011 |
| EP | 2381314 | 10/2011 |
| JP | 2000-191933 | 7/2000 |
| JP | 2000-330321 | 11/2000 |
| JP | 2001-356508 | 12/2001 |
| JP | 2006-039424 | 2/2006 |
| JP | 2009-282218 | 12/2009 |
| JP | 2009-300991 | 12/2009 |
| JP | 2010-275419 | 12/2010 |
| JP | 2011-245860 | 12/2011 |
| WO | 2011-058652 | 5/2011 |

OTHER PUBLICATIONS

Non-Final Office Action for U.S. Appl. No. 13/251,455 dated May 14, 2013, 23 pages.
Office Action of Notification of Reason(s) for Refusal for Japanese Patent Application No. 2011-177698 Dated Jan. 7, 2014, 4 pgs.
Final Office Action for U.S. Appl. No. 13/251,455 dated Oct. 23, 2013, 11 pages.
Non-Final Office Action for U.S. Appl. No. 13/251,455 dated Apr. 9, 2014, 27 pages.
Final Office Action for U.S. Appl. No. 13/251,455 dated Sep. 10, 2014, 9 pages.
Non-Final Office Action for U.S. Appl. No. 13/251,455 dated Mar. 5, 2015, 11 pages.

*Primary Examiner* — Thorl Chea

(74) *Attorney, Agent, or Firm* — Foley & Lardner LLP

(57) ABSTRACT

Disclosed here is a method for producing a decolorizable electrophotographic toner, comprising mixing a first dispersion liquid in which a colorant is dispersed in an amount such that the content of the colorant in the toner is from 5% to 35% by weight, with a second dispersion liquid in which particles containing at least a binder resin and having a volume average particle diameter of 500 nm or less are dispersed, aggregating the colorant and the particles containing at least the binder resin, thereby obtaining aggregated particles, fusing the aggregated particles at a temperature lower than a completely decolorizing temperature of the colorant to obtain the toner, and measuring the number ratio of particles having an equivalent circle diameter of 0.6 μm or more and 2.5 μm or less of the toner using a flow particle image analyzer after the toner is subjected to a stirring treatment.

6 Claims, 3 Drawing Sheets

FIG. 1

| Treatment condition | | | Before homogenizer | | After homogenizer treatment | |
|---|---|---|---|---|---|---|
| Toner ratio (% by weight) | Rotation speed (rpm) | Stirring time (min) | Volume D50 (μm) | Amount of fine powder (% by number) | Volume D50 (μm) | Amount of fine powder (% by number) |
| 0.08 | 5000 | 30 | 10.45 | 12.39 | 10.26 | 23.84 |
| 0.4 | 5000 | 30 | 10.45 | 12.39 | 10.34 | 18.67 |
| 0.8 | 5000 | 30 | 10.45 | 12.39 | 10.31 | 15.61 |
| 0.08 | 2500 | 30 | 10.45 | 12.39 | 10.38 | 14.27 |
| 0.08 | 7500 | 30 | 10.45 | 12.39 | 10.17 | 28.94 |
| 0.08 | 5000 | 10 | 10.45 | 12.39 | 10.28 | 18.24 |
| 0.08 | 5000 | 60 | 10.45 | 12.39 | 10.08 | 30.48 |
| Evaluation using actual apparatus | | | | | 10.24 | 25.31 |

FIG. 2

| Treatment condition | | | Before homogenizer treatment | | After homogenizer treatment | |
|---|---|---|---|---|---|---|
| Toner ratio (% by weight) | Rotation speed (rpm) | Stirring time (min) | Volume D50 (μm) | Amount of fine powder (% by number) | Volume D50 (μm) | Amount of fine powder (% by number) |
| 0.08 | 5000 | 30 | 9.81 | 6.84 | 9.58 | 11.23 |
| Evaluation using actual apparatus | | | | | 9.64 | 13.07 |

FIG. 3

| | Circularity | Colorant | Before homogenizer treatment | | After homogenizer treatment | | Changing ratio | | Evaluation | |
|---|---|---|---|---|---|---|---|---|---|---|
| | | Volume D50 (μm) | Volume D50 (C) (μm) | Amount of fine powder (A) (% by number) | Volume D50 (D) (μm) | Amount of fine powder (B) (% by number) | Volume D50 ((D)/(C)) | Amount of fine powder ((B)/(A)) | Fogging | Toner scattering |
| Example 1 | 0.925 | 2.0 | 9.81 | 6.84 | 9.58 | 11.23 | 0.98 | 1.64 | A | B |
| Example 2 | 0.932 | 3.3 | 10.35 | 8.17 | 10.12 | 15.42 | 0.98 | 1.89 | B | B |
| Example 3 | 0.921 | 0.7 | 10.08 | 12.67 | 9.98 | 21.03 | 0.99 | 1.66 | C | C |
| Example 4 | 0.944 | 2.0 | 10.18 | 9.73 | 9.84 | 28.74 | 0.97 | 2.95 | C | C |
| Example 5 | 0.931 | 2.0 | 10.45 | 12.39 | 10.26 | 23.84 | 0.98 | 1.92 | B | B |
| Comparative Example 1 | 0.942 | 0.4 | 9.95 | 13.47 | 9.81 | 31.38 | 0.99 | 2.37 | D | D |
| Comparative Example 2 | 0.947 | 3.6 | 11.29 | 7.81 | 9.43 | 35.67 | 0.84 | 4.57 | D | D |
| Comparative Example 3 | 0.956 | 2.0 | 9.84 | 10.32 | 9.65 | 32.47 | 0.98 | 3.15 | D | D |
| Comparative Example 4 | 0.876 | 2.0 | 8.95 | 15.94 | 7.61 | 38.91 | 0.85 | 2.44 | D | D |

ELECTROPHOTOGRAPHIC TONER AND METHOD FOR PRODUCING THE SAME

CROSS-REFERENCE TO RELATED APPLICATION

This application is a Division of application Ser. No. 13/251,455 filed Oct. 3, 2011, which is based upon and claims the benefit of priority from U.S. provisional application 61/389,886, filed on Oct. 5, 2010; and Japanese Patent application, 2011-177698, filed on Aug. 15, 2011; the entire contents of all of which are incorporated herein by reference.

FIELD

Embodiments described herein relate to a technique for an electrophotographic toner and a technique for a method for producing the same.

BACKGROUND

Heretofore, a toner which contains a color developable compound and a color developing agent and is decolorized by heating so that an image formed using the toner can be erased is known. In this technique, a color developable compound and a color developing agent are melt-kneaded along with a binder resin by a kneading pulverization method, thereby incorporating the color developable compound and the color developing agent in the inside of the toner. By heating paper printed using this toner at a temperature between 100° C. and 200° C. for about 1 to 3 hours, the printed region can be decolorized, and further, the decolorized paper can be reused. This technique is an excellent technique capable of contributing to a decrease in the environmental load by reducing the consumption of paper.

Among the decolorizable toners, there is a toner in which a colorant (containing a color developable compound and a color developing agent) is incorporated in a capsule, which has a size of about several micrometers. Meanwhile, also a toner has a size of only about several micrometers to 20 μm. Therefore, if the incorporation of a colorant in the form of a capsule is not sufficient, the colorant is significantly exposed on the surface of a binder resin.

Such a toner is subject to stress such as stirring when used in an image forming apparatus such as MFP and is easily broken at the interface between the binder resin and the colorant in the form of a capsule, and therefore is liable to generate fine powder of the binder resin.

As for the measurement of fine powder, a technique in which the amount of a toner in the form of a fine powder (having a small particle diameter, more specifically, having a largest number particle diameter of from 2 to 4 μm or less) is measured using a flow particle image analyzer and a technique in which after a dispersion liquid containing a toner dispersed therein is irradiated with an ultrasonic wave, particles having a size of from 0.5 μm to 2 μm are measured using a flow particle image analyzer are proposed.

However, in these techniques, only the amount of fine powder of a toner after production is measured. Further, by the irradiation with an ultrasonic wave, the amount of fine powder is liable to increase as compared with a toner after production, however, a stress equivalent to that in a developing device cannot be applied to a toner, and therefore, the amount of fine powder when the toner is actually used cannot be reproduced. Therefore, according to a conventional technique, an effect on an image quality such as fogging or contamination of an apparatus due to toner scattering is not sufficiently improved.

DESCRIPTION OF THE DRAWINGS

FIG. 1 is a table showing relations between the amount of generated fine powder and the concentration of a toner, the rotation speed of a homogenizer, and the stirring time.

FIG. 2 is a table showing the amount of generated fine powder after a toner was stirred under a given condition.

FIG. 3 is a table showing the measurement results for toners of Examples and Comparative Examples.

DETAILED DESCRIPTION

An electrophotographic toner according to an embodiment (hereinafter also simply referred to as "toner") contains at least a binder resin and a colorant. The toner according to this embodiment is configured such that the number ratio of particles having an equivalent circle diameter of 0.6 μm or more and 2.5 μm or less of the toner when measured using a flow particle image analyzer after the toner is dispersed in an aqueous medium at a ratio of 0.08% by weight and the resulting dispersion is subjected to a stirring treatment in which stirring is performed at 5000 rpm for 30 minutes using a homogenizer (T-25 digital ULTRA-TURRAX (manufactured by IKA Japan K.K., provided with a shaft generator S25N-10G)) (hereinafter also simply referred to as "stirring treatment" or "homogenizer treatment") is 30% by number or less, more preferably 20% by number or less.

Hereinafter, embodiments will be described with reference to the attached drawings.

In this embodiment, the colorant is covered with an outer shell and therefore has a capsule structure. The present inventors found that in the case of using a decolorizable toner containing a colorant having a capsule structure, particularly a toner containing a colorant having a volume average particle diameter (volume D50) of from 0.5 to 3.5 μm, the cause of fogging or toner scattering is such that a binder resin is liable to be broken at the interface between the binder resin and the colorant due to a stress applied to the toner when an image forming apparatus is operated. When the toner is broken, fine powder of the binder resin is generated. It was also found that particularly if the colorant is significantly exposed on the surface of the toner, such a breakage phenomenon is liable to occur.

Incidentally, among fine powder particles, particles having an equivalent circle diameter of 0.6 μm or more and 2.5 μm or less when measured using a flow particle image analyzer, which will be described later, deteriorate the charging property and have a serious effect on an image quality. As a result of intensive studies, it was found that by subjecting the toner to the above-described stirring treatment, a stress equivalent to that in the case of using the toner in an image forming apparatus can be applied to the toner, and also found that the toner in which the number ratio of particles having an equivalent circle diameter of 0.6 μm or more and 2.5 μm or less when measured using a flow particle image analyzer after the toner is subjected to the stirring treatment is 30% by number or less suppresses the generation of fine powder when the toner is loaded into an image forming apparatus and used, and therefore can improve fogging and toner scattering. Thus, the toner according to this embodiment was completed. In the description of the toner according to this embodiment, particularly the particle having an equivalent circle diameter of 0.6 μm or more and 2.5 μm or less is referred to as fine powder.

Incidentally, the toner according to this embodiment is based on the finding that when the amount of generated fine powder after the stirring treatment is a specific numerical value (30% by number) or less, image fogging or toner scattering can be suppressed. Therefore, the lower limit of the amount of generated fine powder after the stirring treatment is not particularly limited.

Here, the toner according to this embodiment is specified by the measurement of a distribution based on the number of particles using a flow particle image analyzer. The flow particle image analyzer as used herein is a device in which an image of each particle is taken as a two-dimensional image, and from the area of the two-dimensional image of each particle, the diameter of a circle having the same area is calculated as an equivalent circle diameter.

The measurement of toner particles using the flow particle image analyzer can be performed using, for example, a flow particle image analyzer FPIA-2100 manufactured by Sysmex Corporation.

Here, one example of a method for measuring the ratio of fine powder of a toner using the flow particle image analyzer will be described.

In the measurement, a surfactant and a sample are added to an aqueous medium in which the number of particles having an equivalent circle diameter in a measurement range contained in a given volume is reduced to, for example, 20 or less using a filter or the like, and a dispersing treatment is performed using an ultrasonic disperser or the like. By the dispersing treatment, the concentration of particles in the dispersion liquid of the sample is adjusted to $1000\times10^3$ to $15000\times10^3$ particles per milliliter, preferably $6000\times10^3$ to $15000\times10^3$ particles per milliliter (exclusive to particles having an equivalent circle diameter in a measurement range). The dispersion liquid is subjected to the measurement using the flow particle image analyzer, and 2000 or more toner particles are measured. Then, a particle size distribution of particles having an equivalent circle diameter in a range of 0.6 μm or more and less than 400 μm is determined, and the ratio (% by number) of particles having an equivalent circle diameter of 0.6 μm or more and 2.5 μM or less is obtained.

The present inventors also found that when particles are produced by, for example, subjecting the below-described binder resin and colorant to an aggregating treatment and a fusing treatment, the ratio (% by number) of particles having an equivalent circle diameter of 0.6 μm or more and 2.5 μm or less has a relation to the circularity of the particles obtained after the fusing treatment.

The toner according to this embodiment is preferably such that the number ratio (A) of particles having an equivalent circle diameter of 0.6 μm or more and 2.5 μm or less of the toner having not been subjected to the stirring treatment obtained by a measurement using the above-described flow particle image analyzer and the number ratio (B) of particles having an equivalent circle diameter of 0.6 μm or more and 2.5 μm or less of the toner having been subjected to the stirring treatment obtained by a measurement using the above-described flow particle image analyzer satisfy the following relation: $(B)/(A)\leq2.0$. By producing a toner wherein (A) and (B) satisfy the following relation: $(B)/(A)\leq 2.0$, the generation of fine powder due to the breakage of the toner in an image forming apparatus is further suppressed and the charging property can be further improved. Therefore, fogging or contamination of an inside of an apparatus due to toner scattering can be further suppressed.

Incidentally, as described above, since the lower limit of the amount of generated fine powder after the stirring treatment is not particularly limited, the lower limit of (B)/(A) is also not particularly limited.

Still further, the toner according to this embodiment is preferably such that the volume average particle diameter (C) of the toner having not been subjected to the stirring treatment and the volume average particle diameter (D) of the toner having been subjected to the stirring treatment satisfy the following relation: $0.85\leq(D)/(C)$. By producing a toner wherein (C) and (D) satisfy the following relation: $0.85\leq(D)/(C)$, the breakage of the toner is further suppressed and the charging property can be further improved. Therefore, fogging or contamination of an inside of an apparatus due to toner scattering can be further suppressed.

Incidentally, the upper limit of (D)/(C) is not particularly limited, however, in consideration of the effect of the stirring treatment on the toner, the range of (D)/(C) can be set to, for example, $0.85\leq(D)/(C)<1$.

The volume average particle diameter as used herein refers to the particle diameter (volume D50) of a particle the value of which is arrived at when the cumulative volume distribution of the particles reaches 50% determined from the sum of the volumes of the individual particles calculated from the particle diameters. The volume average particle diameter can be determined using, for example, Multisizer 3 (aperture diameter: 100 μm, manufactured by Beckman Coulter, Inc.).

Subsequently, constituent components of the toner according to this embodiment will be described.

The toner according to this embodiment contains a colorant and a binder resin. Incidentally, the colorant as used herein refers to a single compound or a composition that imparts a color to the toner. In this embodiment, the colorant contains a color developable compound and a color developing agent.

Materials of the toner to be used in this embodiment include a binder resin and a colorant and are not particularly limited as long as the produced toner is decolorizable. For example, as components to be contained therein or to be retained on the outer surface thereof as needed other than the above components, a release agent, a charge control agent, an aggregating agent, a neutralizing agent, an external additive, and the like can be exemplified.

In this embodiment, examples of the binder resin include styrene-based resins such as polystyrene, styrene/butadiene copolymers, and styrene/acrylic copolymers; ethylene-based resins such as polyethylene, polyethylene/vinyl acetate copolymers, polyethylene/norbornene copolymers, and polyethylene/vinyl alcohol copolymers; polyester resins, acrylic resins, phenolic resins, epoxy-based resins, allyl phthalate-based resins, polyamide-based resins, and maleic acid-based resins. These resins may be used alone or in combination of two or more kinds thereof.

The binder resin preferably has an acid value of 1 or more.

Further, the above polyester component may be converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

In the toner according to this embodiment, two or more kinds of polyester resins having different compositions may be mixed and used.

Further, in the toner according to this embodiment, the polyester resin may be crystalline or noncrystalline.

Further, as a polystyrene-based resin, a resin obtained by copolymerization of an aromatic vinyl component and a (meth)acrylic acid ester component is preferred. Examples of the aromatic vinyl component include styrene, α-methylstyrene, o-methylstyrene, and p-chlorostyrene. Examples of the acrylic acid ester component include ethyl acrylate, propyl acrylate, butyl acrylate, 2-ethylhexyl acrylate, butyl methacrylate, ethyl methacrylate, and methyl methacrylate. Among these, butyl acrylate is generally used. As the polymerization method, an emulsion polymerization method is generally employed, and the resin is obtained by radical polymerization of monomers of the respective components in an aqueous phase containing an emulsifying agent.

Incidentally, the glass transition temperature of a polyester resin or a polystyrene-based resin is preferably 35° C. or higher and 80° C. or lower, more preferably 40° C. or higher and 75° C. or lower. If the glass transition temperature is lower than 35° C., the storage stability is deteriorated as compared with the case where the glass transition temperature is within the above range, and blocking is caused in a developing device. Meanwhile, if the glass transition temperature is higher than 80° C., a sufficient fixing property cannot be ensured as compared with the case where the glass transition temperature is within the above range.

The weight average molecular weight Mw of the polyester-based resin is preferably 5000 or more and 30000 or less. On the other hand, the weight average molecular weight Mw of the polystyrene-based resin is preferably 10000 or more and 70000 or less. If the weight average molecular weight Mw of the polyester-based resin is less than 5000 (in the case of the polystyrene-based resin, less than 10000), the heat resistance and storage stability of the toner is decreased as compared with the case where the Mw is within the above range. Meanwhile, if the weight average molecular weight Mw of the polyester-based resin is more than 30000 (in the case of the polystyrene-based resin, more than 70000), the fixing temperature is increased as compared with the case where the Mw is within the above range, and therefore, the Mw more than the above range is not preferred from the viewpoint of suppressing the power consumption in a fixing treatment.

The color developable compound is typically a leuco dye and is an electron donating compound capable of developing a color by the action of a color developing agent. Examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more kinds thereof.

The color developing agent which causes the color developable compound to develop a color is an electron accepting compound which donates a proton to the leuco dye. Examples thereof include phenols, metal salts of phenols, metal salts of carboxylic acids, aromatic carboxylic acids, aliphatic carboxylic acids having 2 to 5 carbon atoms, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, or the like, and bisphenols, trisphenols, phenol-aldehyde condensed resins, and metal salts thereof. These compounds may be used by mixing two or more kinds thereof.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as 2,3-dihydroxybenzoic acid methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane, 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol.

An encapsulating agent (shell material) for forming an outer shell of the colorant is also not particularly limited and can be appropriately selected by those skilled in the art.

Further, in this embodiment, a decolorizing agent is contained in the colorant as needed. In a three-component system containing a color developable compound, a color developing agent, and a decolorizing agent, as the decolorizing agent, a known decolorizing agent can be used as long as the agent inhibits a color developing reaction between the leuco dye and the color developing agent through heating, thereby making the material colorless.

As the decolorizing agent, particularly, a color developing and decolorizing mechanism utilizing the temperature hysteresis of a known decolorizing agent disclosed in JP-A-60-264285, JP-A-2005-1369, JP-A-2008-280523, or the like has an excellent instantaneous erasing property. When a mixture of such a three-component system in a color developed state is heated to a specific decolorizing temperature Th or higher, the mixture can be decolorized. Further, even if the decolorized mixture is cooled to a temperature not higher than Th, the decolorized state is maintained. When the temperature of the mixture is further decreased, a color developing reaction between the leuco dye and the color developing agent is restored at a specific color restoring temperature Tc or lower and the mixture returns to the color developed state. In this manner, it is possible to cause a reversible color developing and decolorizing reaction. In particular, it is preferred that the decolorizing agent to be used in this embodiment satisfies the following relation: $Th>Tr>Tc$, wherein Tr represents room temperature.

Examples of the decolorizing agent capable of causing this temperature hysteresis include alcohols, esters, ketones, ethers, and acid amides.

Particularly preferred are esters. Specific examples thereof include esters of carboxylic acids containing a substituted aromatic ring, esters of carboxylic acids containing an unsubstituted aromatic ring with aliphatic alcohols, esters of carboxylic acids containing a cyclohexyl group in each molecule, esters of fatty acids with unsubstituted aromatic alcohols or phenols, esters of fatty acids with branched aliphatic alcohols, esters of dicarboxylic acids with aromatic alcohols or branched aliphatic alcohols, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These compounds may be used by mixing two or more kinds thereof.

Examples of the release agent include aliphatic hydrocarbon-based waxes such as low-molecular weight polyethylenes, low-molecular weight polypropylenes, polyolefin copolymers, polyolefin waxes, microcrystalline waxes, paraffin waxes, and Fischer-Tropsch waxes; oxides of aliphatic hydrocarbon-based waxes such as polyethylene oxide waxes or block copolymers thereof, vegetable waxes such as candelilla wax, carnauba wax, Japan wax, jojoba wax, and rice wax; animal waxes such as bees wax, lanolin, and spermaceti wax; mineral waxes such as ozokerite, ceresin, and petrolactam; waxes containing, as a main component, a fatty acid ester such as montanic acid ester wax and castor wax; and materials obtained by deoxidization of a part or the whole of a fatty acid ester such as deoxidized carnauba wax. Further, saturated linear fatty acids such as palmitic acid, stearic acid, montanic acid, and long-chain alkyl carboxylic acids having a long-chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long-chain alkyl alcohols having a long-chain alkyl group; polyhydric alcohols such as sorbitol; fatty acid amides such as linoleic acid amide, oleic acid amide, and lauric acid amide; saturated fatty acid bisamides such as methylenebis stearic acid amide, ethylenebis caprylic acid amide, ethylenebis lauric acid amide, and hexamethylenebis stearic acid amide; unsaturated fatty acid amides such as ethylenebis oleic acid amide, hexamethylenebis oleic acid amide, N,N'-dioleyl adipic acid amide, and N,N'-dioleyl sebacic acid amide; aromatic bisamides such as m-xylenebis stearic acid amide, and N,N'-distearyl isophthalic acid amide; fatty acid metal salts (generally called metallic soaps) such as calcium stearate, calcium laurate, zinc stearate, and magnesium stearate; waxes obtained by grafting of a vinyl-based monomer such as styrene or acrylic acid on an aliphatic hydrocarbon-based wax; partially esterified products of a fatty acid and a polyhydric alcohol such as behenic acid monoglyceride; and methyl ester compounds having a hydroxyl group obtained by hydrogenation of a vegetable fat or oil can be exemplified.

The charge control agent is added for controlling a frictional charge amount. As the charge control agent, for example, a positively chargeable charge control agent such as a nigrosine-based dye, a quaternary ammonium-based compound, or a polyamine-based resin can be used. Further, a negatively chargeable charge control agent such as a metal-containing azo compound wherein the metal element is a complex or a complex salt of iron, cobalt, or chromium, or a mixture thereof or a metal-containing salicylic acid derivative compound wherein the metal element is a complex or a complex salt of zirconium, zinc, chromium, or boron, or a mixture thereof can be used.

Examples of the surfactant include anionic surfactants such as sulfate ester salt-based, sulfonate-based, phosphate ester-based, and soap-based anionic surfactants; cationic surfactants such as amine salt-based and quaternary ammonium salt-based cationic surfactants; and nonionic surfactants such as polyethylene glycol-based, alkyl phenol ethylene oxide adduct-based, and polyhydric alcohol-based nonionic surfactants.

When the toner according to this embodiment is produced through an aggregating step and a fusing step, an aggregating agent is used for producing the toner according to this embodiment. Examples of the aggregating agent include metal salts such as sodium chloride, calcium chloride, calcium nitrate, barium chloride, magnesium chloride, zinc chloride, magnesium sulfate, aluminum chloride, aluminum sulfate, and potassium aluminum sulfate; inorganic metal salt polymers such as polyaluminum chloride, polyaluminum hydroxide, and calcium polysulfide; polymeric aggregating agents such as polymethacrylic esters, polyacrylic esters, polyacrylamides, and acrylamide sodium acrylate copolymers; coagulating agents such as polyamines, polydiallyl ammonium halides, melanin formaldehyde condensates, and dicyandiamide; alcohols such as methanol, ethanol, 1-propanol, 2-propanol, 2-methyl-2-propanol, 2-methoxyethanol, 2-ethoxyethanol, and 2-butoxyethanol;

organic solvents such as acetonitrile and 1,4-dioxane; inorganic acids such as hydrochloric acid and nitric acid; and organic acids such as formic acid and acetic acid.

As the neutralizing agent, an inorganic base or an amine compound can be used. Examples of the inorganic base include sodium hydroxide and potassium hydroxide. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, and N,N-diethyl-1,3-diaminopropane.

As the external additive, for example, inorganic fine particles can be externally added and mixed in an amount of from 0.01 to 20% by weight based on the amount of the toner particles for adjusting the fluidity or chargeability. As the inorganic fine particles, silica, titania, alumina, strontium titanate, and tin oxide can be used alone or by mixing two or more kinds thereof. It is preferred that as the inorganic fine particles, those surface-treated with a hydrophobizing agent are used from the viewpoint of improvement of environmental stability. Further, other than such inorganic oxides, resin fine particles having a size of 1 μm or less may be externally added for improving the cleaning property.

Subsequently, a method for producing the toner according to this embodiment will be described. The toner according to this embodiment can be produced by, for example, aggregating and fusing an encapsulated colorant and binder resin particles.

Examples of a method for forming the encapsulated colorant include an interfacial polymerization method, a coacervation method, an in-situ polymerization method, a submerged drying method, and a submerged curing coating method.

In particular, an in-situ method in which a melamine resin is used as a shell component, an interfacial polymerization method in which a urethane resin is used as a shell component, or the like is preferred.

In the case of an in-situ method, first, the above-described three components (a color developable compound, a color developing agent, and a decolorizing agent to be added as needed) are dissolved and mixed, and then, the resulting mixture is emulsified in an aqueous solution of a water-soluble polymer or a surfactant. Thereafter, an aqueous solution of a melamine formalin prepolymer is added thereto, followed by heating to effect polymerization, whereby encapsulation can be achieved.

In the case of an interfacial polymerization method, the above-described three components and a polyvalent isocyanate prepolymer are dissolved and mixed, and then, the resulting mixture is emulsified in an aqueous solution of a water-soluble polymer or a surfactant. Thereafter, a polyvalent base such as a diamine or a diol is added thereto, followed by heating to effect polymerization, whereby encapsulation can be achieved.

The volume D50 of the colorant is not particularly limited and can be appropriately set by those skilled in the art. However, if the volume D50 of the colorant is small, a color material having a poor color developing property may be formed in some cases, and if a toner containing such a colorant having a poor color developing property is produced, a sufficient image density cannot be obtained.

Therefore, from the viewpoint of the color developing property of the colorant, the volume D50 of the colorant is preferably from 0.5 to 3.5 μm.

Further, it was experimentally confirmed that if the volume D50 is outside the range of from 0.5 to 3.5 μm, the incorporation of the colorant is deteriorated as compared with the case where the volume D50 is within the above range. Although the mechanism of the deterioration of the incorporation of the colorant having a small diameter is not accurately understood, in the case of using an encapsulated colorant, if the colorant has a particle diameter less than a given value, the incorporation of the colorant in the binder resin is deteriorated and the amount of generated fine powder is increased (see FIG. 3, which will be described later).

Further, although depending on the specific kinds of the color developable compound and the color developing agent, by placing the encapsulated colorant at a temperature, for example, between −20° C. and −30° C., the color developable compound and the color developing agent can be coupled to each other to develop a color.

Subsequently, the encapsulated colorant prepared as described above and particles containing a binder resin are aggregated. Specifically, an aggregating agent is added to a dispersion liquid in which the colorant and the particles containing a binder resin are dispersed in a dispersion medium, for example, an aqueous dispersion medium such as water, followed by heating, whereby these components are aggregated. The kind of the aggregating agent, the addition amount thereof, and the heating temperature can be appropriately set by those skilled in the art.

Subsequently, the fluidity of the binder resin is increased by heating, and the aggregated first aggregated particles and resin fine particles are fused.

The heating temperature in the fusing treatment can also be appropriately set by those skilled in the art.

Incidentally, the circularity of the particles obtained by the fusing treatment is preferably, for example, from 0.88 to 0.95. If the circularity is less than 0.88, the particles are not sufficiently fused and the strength of the toner is low and is liable to be broken as compared with the case where the circularity is within the above range, and therefore, fine powder is easily generated. Meanwhile, if the circularity is more than 0.95, the strength of the toner is sufficient, however, the colorant is liable to be separated although the mechanism is not elucidated yet, and as a result, fine powder is easily generated as compared with the case where the circularity is within the above range. The circularity can be adjusted by, for example, changing the temperature during the fusing treatment (a target temperature when the temperature is raised after adding the aggregating agent) and the time period of the fusing treatment. Further, the size of the particles obtained by the fusing treatment is not particularly limited and can be appropriately set by those skilled in the art in consideration of the particle diameter of the toner to be produced or the like.

The circularity can be obtained by a measurement using a flow particle image analyzer.

Specifically, by using a flow particle image analyzer, an equivalent circle diameter as a particle diameter is measured for particles having an equivalent circle diameter in a range of from 0.60 to 400 μm. Then, the circularity of each measured particle is calculated from the following formula (1), and a value obtained by dividing the sum of the circularities by the total number of the particles is taken as a circularity. The measurement is performed for 1000 to 1500 particles, and a calculated value is taken as an average circularity.

$$n = l/m \quad (1)$$

In the formula (1), n represents a circularity, l represents a perimeter of a circle having the same projected area as that of a particle image, and m represents a perimeter of a projected image of a particle.

Subsequently, the particles obtained by the fusing treatment are washed and dried, whereby a toner is produced.

To the thus produced toner, an external additive is externally added as needed. The volume D50 of the electrophotographic toner is not particularly limited, but is preferably from 4 to 20 μm from the viewpoint of the handling of the toner or the image quality.

Further, in the toner according to this embodiment, the ratio of each component to be contained is not particularly limited and can be appropriately set by those skilled in the art. However, the amount of the colorant to be contained in the electrophotographic toner is preferably from 5 to 35% by weight. If the amount is less than 5% by weight, a sufficient color developing property cannot be ensured although the incorporation thereof is favorable. If the amount is more than 35% by weight, the colorant is liable to be deposited on the surface of the toner, and also the interface between the binder resin and the colorant is increased, and therefore, when a stress is applied to the toner, fine powder is easily generated as compared with the case where the amount is within the above range.

The toner obtained by the method for producing the toner according to this embodiment is mixed with a carrier to form a developer in the same manner as a common toner and the developer is loaded into an image forming apparatus such as an MET (multifunction peripheral) and is used for forming an image on a recording medium.

In an image forming step, a toner image formed with the toner according to this embodiment transferred onto a recording medium is heated at a fixing temperature, and therefore a resin is melted to penetrate in the recording medium, and thereafter the resin is solidified, whereby an image is formed on the recording medium (fixing treatment).

Further, the image formed on the recording medium can be erased by performing a decolorizing treatment of the toner. Specifically, the decolorizing treatment can be performed as follows. The recording medium having an image formed thereon is heated at a heating temperature not lower than the decolorizing initiation temperature, thereby decoupling the coupled color developable compound and color developing agent from each other.

Hereinafter, the toner according to this embodiment will be described in more detail with reference to Examples. However, the invention is by no means limited to the following Examples.

[Preparation of Dispersion Liquid 1 of Finely Pulverized Mixture of Resin and Release Agent]

95 parts by weight of a polyester resin (Tg: 52° C.) as a binder resin and 5 parts by weight of an ester wax as a release agent were mixed, and the resulting mixture was melt-kneaded using a twin-screw kneader which was set to a temperature of 120° C., whereby a kneaded composition was obtained.

The thus obtained kneaded composition was coarsely pulverized to a volume average particle diameter of 1.2 mm using a hammer mill manufactured by Nara Machinery Co., Ltd., whereby coarse particles were obtained.

The thus obtained coarse particles were moderately pulverized to a volume average particle diameter of 0.05 mm using a bantam mill manufactured by Hosokawa Micron Corporation, whereby moderately pulverized particles were obtained.

30 parts by weight of the thus obtained moderately pulverized particles, 1.2 parts by weight of a sodium alkyl benzene sulfonate as an anionic surfactant, 1 part by weight of triethylamine as an amine compound, and 67.8 parts by weight of ion exchanged water were processed at 160 MPa and 180° C. using NANO 3000, whereby a dispersion liquid in which particles having a volume average particle diameter of 500 nm were dispersed was prepared.

[Preparation of Dispersion Liquid 2 of Finely Pulverized Mixture of Resin and Release Agent]

95 parts by weight of a polyester resin (Tg: 57° C.) as a binder resin and 5 parts by weight of an ester wax as a release agent were mixed, and the resulting mixture was melt-kneaded using a twin-screw kneader which was set to a temperature of 120° C., whereby a kneaded composition was obtained.

The thus obtained kneaded composition was coarsely pulverized to a volume average particle diameter of 1.2 mm using a hammer mill manufactured by Nara Machinery Co., Ltd., whereby coarse particles were obtained.

The thus obtained coarse particles were moderately pulverized to a volume average particle diameter of 0.05 mm using a bantam mill manufactured by Hosokawa Micron Corporation, whereby moderately pulverized particles were obtained.

30 parts by weight of the thus obtained moderately pulverized particles, 1.2 parts by weight of a sodium alkyl benzene sulfonate as an anionic surfactant, 1 part by weight of triethylamine as an amine compound, and 67.8 parts by weight of ion exchanged water were processed at 160 MPa and 180° C. using NANO 3000, whereby a dispersion liquid in which particles having a volume average particle diameter of 350 nm were dispersed was prepared.

[Preparation of Colorant Dispersion Liquid 1]

Components composed of 1 part by weight of 3-(2-ethoxy-4-diethylaminophenyl)-3-(1-ethyl-2-methylindol-3-yl)-4-azaphthalide as a leuco dye, 5 parts by weight of 2,2-bis(4-hydroxyphenyl)hexafluoropropane as a color developing agent, and 50 parts by weight of a diester compound of pimelic acid and 2-(4-benzyloxyphenyl)ethanol as a decolorizing agent were dissolved by heating. Then, a solution obtained by mixing the components dissolved by heating, and 20 parts by weight of an aromatic polyvalent isocyanate prepolymer and 40 parts by weight of ethyl acetate as encapsulating agents was poured into 250 parts by weight of an aqueous solution of 8% polyvinyl alcohol, and the resulting mixture was emulsified and dispersed. After stirring of the dispersion was continued at 70° C. for about 1 hour, 2 parts by weight of a water-soluble aliphatic modified amine as a reaction agent was added thereto, and the stirring of the dispersion was further continued for about 3 hours while maintaining the temperature of the liquid at 90° C., whereby colorless encapsulated particles were obtained. Further, the resulting encapsulated particle dispersion was placed in a freezer (−30° C.) to develop a color, whereby a dispersion of blue color developed particles C1 was obtained. The volume average particle diameter of the color developed particles C1 was measured using SALD-7000 manufactured by Shimadzu Corporation and found to be 2 μm. Further, the completely decolorizing temperature Th was 79° C. and the completely color developing temperature Tc was −20° C.

[Preparation of Colorant Dispersion Liquid 2]

Components composed of 2 parts by weight of 3-(4-diethylamino-2-hexyloxyphenyl)-3-(1-ethyl-2-methylindol-3-yl)-4-azaphthalide as a leuco dye, 4 parts by weight of 1,1-bis(4'-hydroxyphenyl)hexafluoropropane and 4 parts by weight of 1,1-bis(4'-hydroxyphenyl)-n-decane as color developing agents, and 50 parts by weight of 4-benzyloxyphenylethyl caprylate as a decolorizing agent were uniformly dissolved by heating. Then, a solution obtained by mixing the components dissolved by heating, and 30 parts by weight of an aromatic polyvalent isocyanate prepolymer and 40 parts by weight of ethyl acetate as encapsulating agents was poured into 300 parts by weight of an aqueous solution of 8% polyvinyl alcohol, and the resulting mixture was emulsified and dispersed. After stirring of the dispersion was continued at 70° C. for about 1 hour, 2.5 parts by weight of a water-soluble aliphatic modified amine as a reaction agent was added thereto, and the stirring of the dispersion was further continued for about 6 hours, whereby colorless encapsulated particles were obtained. Further, the resulting encapsulated particle dispersion was placed in a freezer (−30° C.) to develop a color, whereby a dispersion of blue color developed particles C2 was obtained. The volume average particle diameter of the color developed particles C2 was measured using SALD-7000 manufactured by Shimadzu Corporation and found to be 3.3 μm. Further, the completely decolorizing temperature Th was 55° C. and the completely color developing temperature Tc was −24° C.

[Preparation of Colorant Dispersion Liquid 3]

Components composed of 1 part by weight of 3-(2-ethoxy-4-diethylaminophenyl)-3-(1-ethyl-2-methylindol-3-yl)-4-azaphthalide as a leuco dye, 5 parts by weight of 2,2-bis(4-hydroxyphenyl)hexafluoropropane as a color developing agent, and 50 parts by weight of a diester compound of pimelic acid and 2-(4-benzyloxyphenyl)ethanol as a decolorizing agent were dissolved by heating. Then, a solution obtained by mixing the components dissolved by heating, and 20 parts by weight of an aromatic polyvalent isocyanate prepolymer and 40 parts by weight of ethyl acetate as encapsulating agents was poured into 250 parts by weight of an aqueous solution of 8% polyvinyl alcohol, and the resulting mixture was emulsified and dispersed. After stirring of the dispersion was continued at 70° C. for about 1 hour, 2 parts by weight of a water-soluble aliphatic modified amine as a reaction agent was added thereto, and the stirring of the dispersion was further continued for about 1.5 hours while maintaining the temperature of the liquid at 90° C., whereby colorless encapsulated particles were obtained. Further, the resulting encapsulated particle dispersion was placed in a freezer to develop a color, whereby a dispersion of blue color developed particles C3 was obtained. The volume average particle diameter of the color developed particles C3 was measured using SALD-7000 manufactured by Shimadzu Corporation and found to be 1.0 μm. Further, the completely decolorizing temperature Th was 79° C. and the completely color developing temperature Tc was −30° C.

[Preparation of Colorant Dispersion Liquid 4]

Components composed of 1 part by weight of 3-(2-ethoxy-4-diethylaminophenyl)-3-(1-ethyl-2-methylindol-3-yl)-4-azaphthalide as a leuco dye, 5 parts by weight of 2,2-bis(4-hydroxyphenyl)hexafluoropropane as a color developing agent, and 50 parts by weight of a diester compound of pimelic acid and 2-(4-benzyloxyphenyl)ethanol as a decolorizing agent were dissolved by heating. Then, a solution obtained by mixing the components dissolved by heating, and 20 parts by weight of an aromatic polyvalent isocyanate prepolymer and 40 parts by weight of ethyl acetate as encapsulating agents was poured into 250 parts by weight of an aqueous solution of 8% polyvinyl alcohol, and the resulting mixture was emulsified and dispersed. After stirring of the dispersion was continued at 90° C. for about 1 hour, 2 parts by weight of a water-soluble aliphatic modified amine as a reaction agent was added thereto, and the stirring of the dispersion was further continued for about 1 hour while maintaining the temperature of the liquid at 90° C., whereby colorless encapsulated particles were obtained. Further, the resulting encapsulated particle dispersion was placed in a freezer to develop a color, whereby a dispersion of blue color developed particles C4 was obtained. The volume average particle diameter of the color developed particles C4 was measured using SALD-7000 manufactured by Shimadzu Corporation and found to be 0.4 μm. Further, the completely decolorizing temperature Th was 79° C. and the completely color developing temperature Tc was −35° C.

[Preparation of Colorant Dispersion Liquid 5]

Components composed of 2 parts by weight of 3-(4-diethylamino-2-hexyloxyphenyl)-3-(1-ethyl-2-methylindol-3-yl)-4-azaphthalide as a leuco dye, 4 parts by weight of 1,1-bis(4'-hydroxyphenyl)hexafluoropropane and 4 parts by weight of 1,1-bis(4'-hydroxyphenyl)-n-decane as color developing agents, and 50 parts by weight of 4-benzyloxyphenylethyl caprylate as a decolorizing agent were uniformly dissolved by heating. Then, a solution obtained by mixing the components dissolved by heating, and 30 parts by weight of an aromatic polyvalent isocyanate prepolymer and 40 parts by weight of ethyl acetate as encapsulating agents was poured into 300 parts by weight of an aqueous solution of 8% polyvinyl alcohol, and the resulting mixture was emulsified and dispersed. After stirring of the dispersion was continued at 70° C. for about 1 hour, 2.5 parts by weight of a water-soluble aliphatic modified amine as a reaction agent was added thereto, and the stirring of the dispersion was further continued for about 6.5 hours, whereby colorless encapsulated particles were obtained. Further, the resulting encapsulated particle dispersion was placed in a freezer to develop a color, whereby a dispersion of blue color developed particles C5 was obtained. The volume average particle diameter of the color developed particles C5 was measured using SALD-7000 manufactured by Shimadzu Corporation and found to be 3.6 μm. Further, the completely decolorizing temperature Th was 55° C. and the completely color developing temperature Tc was −24° C.

Example 1

To 15 parts by weight of the resin and release agent dispersion liquid 1, 1.7 parts by weight of the colorant dispersion liquid 1 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 70° C. and the mixture was left as such for 1 hour.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

Example 2

To 15 parts by weight of the resin and release agent dispersion liquid 1, 1.7 parts by weight of the colorant dispersion liquid 2 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 70° C. and the mixture was left as such for 1 hour.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

Example 3

To 15 parts by weight of the resin and release agent dispersion liquid 1, 1.7 parts by weight of the colorant dispersion liquid 3 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 70° C. and the mixture was left as such for 1 hour.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

Example 4

To 15 parts by weight of the resin and release agent dispersion liquid 1, 1.7 parts by weight of the colorant dispersion liquid 1 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 80° C. and the mixture was left as such for 1 hour.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

Example 5

To 15 parts by weight of the resin and release agent dispersion liquid 2, 1.7 parts by weight of the colorant dispersion liquid 1 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 75° C. and the mixture was left as such for 1 hour.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

Comparative Example 1

To 15 parts by weight of the resin and release agent dispersion liquid 1, 1.7 parts by weight of the colorant dispersion liquid 4 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 80° C. and the mixture was left as such for 1 hour.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

Comparative Example 2

To 15 parts by weight of the resin and release agent dispersion liquid 1, 1.7 parts by weight of the colorant dispersion liquid 5 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 80° C. and the mixture was left as such for 1 hour.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

Comparative Example 3

To 15 parts by weight of the resin and release agent dispersion liquid 1, 1.7 parts by weight of the colorant dispersion liquid 1 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 80° C. and the mixture was left as such for 2 hours.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

Comparative Example 4

To 15 parts by weight of the resin and release agent dispersion liquid 1, 1.7 parts by weight of the colorant dispersion liquid 1 and 68.5 parts by weight of ion exchanged water were added and mixed. Then, as an aggregating agent, 5 parts by weight of an aqueous solution of 5% by weight of aluminum sulfate was added thereto at 30° C. After the addition of the metal salt, the temperature of the resulting mixture was raised to 40° C. and the mixture was left as such for 1 hour. Then, 10 parts by weight of an aqueous solution of 10% by weight of a sodium salt of polycarboxylic acid was added thereto, and the temperature of the resulting mixture was raised to 65° C.

After cooling, the solid matter in the obtained dispersion liquid was washed by repeating a washing procedure including centrifugation using a centrifugal separator, removal of the resulting supernatant, and washing of the remaining solid matter with ion exchanged water until the electrical conductivity of the supernatant became 50 μS/cm. Thereafter, the resulting solid matter was dried using a vacuum dryer until the water content therein became 1.0% by weight or less, whereby toner particles were obtained.

After drying, as additives, 2 parts by weight of hydrophobic silica and 0.5 parts by weight of titanium oxide were attached to the surfaces of the toner particles, whereby a desired electrophotographic toner was obtained.

<Measurement Using Flow Particle Image Analyzer>

The measurement of particles having an equivalent circle diameter of 0.6 μm or more and 2.5 μm or less was performed using a flow particle image analyzer (FPIA-2100 manufactured by Sysmex Corporation).

A toner sample was prepared as follows. First, in a 100 ml beaker, 40 mg of a toner sample was placed, and 2 ml of an alkyl benzene sulfonate (a dispersing agent) was added thereto, and the resulting mixture was dispersed by an ultrasonic wave for 5 minutes. Then, a particle sheath reagent was added thereto to make the total volume 30 ml, and the resulting mixture was dispersed again by an ultrasonic wave for 5 minutes, whereby a toner sample for measurement was prepared.

By using the flow particle image analyzer, still images of toner particles dispersed in the toner sample for measurement were taken and the images were analyzed. For each toner sample for measurement, 2000 or more toner particles were measured, and a particle size distribution of particles having an equivalent circle diameter in a range of 0.6 μm or more and less than 400 μm was determined, and then, the ratio (% by number) of particles having an equivalent circle diameter of 0.6 μm or more and 2.5 μm or less was obtained.

Further, a sample of particles obtained by fusion was prepared such that the concentration of the particles at the measurement was in the range of from $6000\times10^3$ to $15000\times10^3$ particles per milliliter, and the circularity of the particles obtained by fusion was determined using the flow particle image analyzer.

<Determination of Condition for Homogenizer Treatment>

First, a 5 wt % toner dispersion liquid was prepared using the toner of Example 5. To 0.1 mL of the 5 wt % toner dispersion liquid, 0.1 mL of 10 wt % palm soap and 5.8 mL of ion exchanged water were added so that the ratio of the toner was adjusted to 0.08% by weight. Further, the respective dispersion liquids in which the toner was dispersed at a ratio shown in FIG. 1 were prepared by diluting the dispersion liquid in which the toner was dispersed at 0.08% by weight.

The volume D50 (μm) of the toner contained in each dispersion liquid was 10.45 μm. Further, from the results of the measurement using FPIA-2100 (manufactured by Sysmex Corporation), the ratio of particles having an equivalent circle diameter of 0.6 μm or more and 2.5 μm or less was 12.39% by number.

Each of the respective dispersion liquids containing the toner at a different ratio was subjected to a stirring treatment using T-25 digital ULTRA-TURRAX (manufactured by IKA Japan K.K., provided with a shaft generator S25N-10G) at a rotation speed shown in FIG. 1 for a stirring time shown in FIG. 1.

Further, the toner of Example 5 was mixed with a ferrite carrier coated with a silicone resin and the resulting mixture was loaded into an MFP e-STUDIO 4520C manufactured by Toshiba Tec Corporation. Then, the apparatus was operated under an aging condition and 3000 sheets of paper were output. Thereafter, fine powder generated was confirmed by a measurement using the flow particle image analyzer. The amount of fine powder is shown in FIG. 1 as the result of evaluation using an actual apparatus.

From the results shown in FIG. 1, it is understood that when the toner is dispersed in water at a ratio of 0.08% by weight and the resulting dispersion liquid is subjected to a stirring treatment at a rotation speed of 5000 rpm for 30 minutes, a stress equivalent to that applied to the toner when an actual apparatus is operated can be applied to the toner.

Accordingly, in the same manner as described above, by using the toner of Example 1, the amount of generated fine powder was measured for the case where the toner was loaded into an MFP e-STUDIO 4520C manufactured by Toshiba Tec Corporation and for the case where the toner was dispersed in water at a ratio of 0.08% by weight and the resulting dispersion liquid was subjected to a stirring treatment at a rotation speed of 5000 rpm for 30 minutes. As a result, the amount of generated fine powder when the toner was dispersed in water at a ratio of 0.08% by weight and the resulting dispersion liquid was subjected to a stirring treatment at a rotation speed of 5000 rpm for 30 minutes was extremely approximate to the amount of fine powder of the toner generated when the actual apparatus was operated. FIG. 2 shows the amount of generated fine powder when the toner was dispersed in water at a ratio of 0.08% by weight and the resulting dispersion liquid was subjected to a stirring treatment at a rotation speed of 5000 rpm for 30 minutes and the amount of fine powder of the toner generated when the actual apparatus was operated.

Further, also for the toners of the other Examples and Comparative Examples, the amount of generated fine powder when the toner was dispersed in water at a ratio of 0.08% by weight and the resulting dispersion liquid was subjected to a stirring treatment at a rotation speed of 5000 rpm for 30 minutes was extremely approximate to the amount of fine powder of the toner generated when the actual apparatus was operated.

From these results, it is understood that by dispersing the toner in water at a ratio of 0.08% by weight and subjecting the resulting dispersion liquid to a stirring treatment at a rotation speed of 5000 rpm for 30 minutes, a stress can be applied to the toner in the same manner as in the case of using the toner in an actual apparatus.

On the basis of the determination of the condition for stirring as described above, each of the toners of Examples and Comparative Examples was subjected to the stirring treatment, and thereafter, the ratio (% by number) of particles having an equivalent circle diameter of 0.6 μm or more and 2.5 μm or less of each toner was measured using the flow particle image analyzer (FPIA-2100 manufactured by Sysmex Corporation), which is shown in FIG. 3. Also, the volume average particle diameter D50 was measured using Multisizer 3 (aperture diameter: 100 μm) manufactured by Beckman Coulter Inc. for each of the toners of Examples and Comparative Examples. Incidentally, FIG. 2 shows the ratio (% by number) of particles having an equivalent circle diameter of 0.6 μm or more and 2.5 μm or less and the value obtained by measuring the volume average particle diameter D50 before performing the homogenizer treatment and also shows the ratio (% by number) of particles having an equivalent circle diameter of 0.6 μm or more and 2.5 μm or less and the value obtained by measuring the volume average particle diameter D50 after performing the homogenizer treatment.

Further, FIG. 3 shows also the circularity of particles measured using the flow particle image analyzer when the fusion treatment was completed.

<Evaluation of Fogging and Toner Scattering>

For the toners of Examples and Comparative Examples, fogging and toner scattering were evaluated. The results are shown in FIG. 3.

The evaluation of fogging was specifically performed as follows. Three sheets of paper were continuously copied, and a reflectance of each of the first, second and third sheets among the three sheets was measured using X-Rite 938, and a difference between an average of the reflectances thereof and an average of reflectances of a sheet of non-transfer paper (2 sites per sheet) was determined.

In FIG. 3, A represents the case where the difference is less than 0.20; B represents the case where the difference is less than 0.30; C represents the case where the difference is less than 0.40; and D represents the case where the difference is 0.40 or more.

Further, the evaluation of toner scattering was specifically performed as follows. Each toner was loaded into an MFP e-STUDIO 4520C manufactured by Toshiba Tec Corporation, and 3000 sheets of paper were fed through the MFP, and the scattering amount of the toner was determined. In FIG. 3, A represents the case where the scattering amount is less than 10 mg; B represents the case where the scattering amount is less than 25 mg; C represents the case where the scattering amount is less than 50 mg; and D represents the case where the scattering amount is 50 mg or more.

From the results of the toners of Examples and Comparative Examples, in the case of using the toners in which the ratio of particles having an equivalent circle diameter of 0.6 μm or more and 2.5 μm or less of the toner when measured using the flow particle image analyzer after the homogenizer treatment was 30% by number or less, excellent results were obtained for fogging and toner scattering as compared with the case of using the toners of Comparative Examples.

Further, in the case of using the toners in which the value of (B)/(A) which represents the changing ratio of the amount of fine powder in FIG. 3 was 2.0 or less, fogging and toner scattering could be further improved. Moreover, in the case of using the toners in which the value of (D)/(C) which represents the changing ratio of the volume D50 in FIG. 3 was 0.85 or more, fogging and toner scattering could be further improved.

<Evaluation of Decolorizing Property>

Each of the toners of Examples and Comparative Example 1 was mixed with a ferrite carrier coated with a silicone resin, and an image was output using an MFP (e-STUDIO 4520C) manufactured by Toshiba Tec Corporation. The temperature of the fixing device was set to 70° C. and the paper conveying speed was adjusted to 30 mm/sec. Except for the case of using the toner of Comparative Example 1, in the case of using any of the toners of Examples, a color developed image having an image density of 0.5 could be formed on a paper medium. In the case of using the toner of Comparative Example 1, a sufficient image density could not be obtained.

Further, it was confirmed that by setting the temperature of the fixing device to 100° C. and conveying the paper medium having a color developed image formed thereon with each of the toners of Examples at a paper conveying speed of 100 mm/sec, the formed image turned into colorless.

Further, it was confirmed that when the paper medium on which the image was erased was stored in a freezer at −30° C., the image density was restored to 0.5 which was equivalent to that before decolorization.

As described in detail above, according to the technique described in this specification, a technique capable of improving an image quality for a decolorizable toner containing an encapsulated colorant can be provided.

While certain embodiments have been described, these embodiments have been presented by way of example only, and are not intended to limit the scope of invention. Indeed, the novel toner and method described herein may be embodied in a variety of other forms; furthermore, various omissions, substitutions and changes in the form of the toner and method described herein may be made without departing from the spirit of the inventions. The accompanying claims and their equivalents are intended to cover such forms or modifications as would fall within the scope and spirit of the inventions.

What is claimed is:

1. A method for producing a decolorizable electrophotographic toner, comprising:

mixing a first dispersion liquid in which a colorant is dispersed in an amount such that the content of the colorant in the toner is from 5% to 35% by weight, with a second dispersion liquid in which particles containing at least a binder resin and having a volume average particle diameter of 500 nm or less are dispersed, wherein the colorant contains at least a color developable compound and a color developing agent and is covered with an outer shell so as to have a capsule structure and has a volume average particle diameter of from 0.5 to 3.5 μm, and the binder resin is a polyester-based resin having a weight average molecular weight Mw of 5000 or more and 30000 or less, aggregating the colorant and the particles containing at least the binder resin, thereby obtaining aggregated particles, fusing the aggregated particles at a temperature lower than a completely decolorizing temperature of the colorant to obtain the toner, and measuring the number ratio of particles having an equivalent circle diameter of 0.6 μm or more and 2.5 μm or less relative to the total number of toner particles of the toner using a flow particle image analyzer after the toner is dispersed in an aqueous medium at a ratio of 0.08% by weight and then subjected to a stirring treatment in which stirring is performed at 5000 rpm for 30 minutes using a homogenizer, wherein a toner in which the number ratio of particles having an equivalent circle diameter of 0.6 μm or more and 2.5 μm or less after the toner is subjected to the stirring treatment is 30% by number or less suppresses the generation of fine powder when loading and using the toner in an image forming apparatus and thereby suppresses fogging and toner scattering.

2. The method according to claim 1, wherein the number ratio (A) of particles having an equivalent circle diameter of 0.6 μm or more and 2.5 μm or less of the toner having not been subjected to the stirring treatment obtained by a measurement using the flow particle image analyzer and the number ratio (B) of particles having an equivalent circle diameter of 0.6 μm or more and 2.5 μm or less of the toner having been subjected to the stirring treatment obtained by a measurement using the flow particle image analyzer satisfy the following relation: $(B)/(A) \leq 2.0$.

3. The method according to claim 1, wherein volume average particle diameter (C) of the toner having not been subjected to the stirring treatment and volume average particle diameter (D) of the toner having been subjected to the stirring treatment satisfy the following relation: $0.85 \leq (D)/(C)$.

4. The method according to claim 2, wherein volume average particle diameter (C) of the toner having not been subjected to the stirring treatment and volume average particle diameter (D) of the toner having been subjected to the stirring treatment satisfy the following relation: $0.85 \leq (D)/(C)$.

5. The method according to claim 1, wherein the volume average particle diameter of the colorant is from 0.5 to 3.5 μm.

6. The method according to claim 1, wherein volume average particle diameter of the toner before or after the stirring treatment is from 4 to 20 μm.

* * * * *